US005456990A

United States Patent [19]

Takagi et al.

[11] Patent Number: 5,456,990

[45] Date of Patent: Oct. 10, 1995

[54] MAGNETIC TONER

[75] Inventors: Seiichi Takagi; Toshiyuki Yano; Hiroe Okuyama; Teruo Masukawa; Sueko Sakai; Emi Takahashi, all of Minami-ashigara, Japan

[73] Assignee: Fuji Xerox Co., Ltd., Tokyo, Japan

[21] Appl. No.: 214,237

[22] Filed: Mar. 17, 1994

[30] Foreign Application Priority Data

Mar. 18, 1993 [JP] Japan ..... 5-082504

[51] Int. Cl.[6] ..... G03G 9/083; G03G 9/097

[52] U.S. Cl. ..... 430/106.6; 430/110; 430/111; 430/903

[58] Field of Search ..... 430/106.6, 110, 430/111

[56] References Cited

U.S. PATENT DOCUMENTS 4,946,755 8/1990 Inoue ..... 430/106.6
5,137,796 8/1992 Takiguchi et al. ..... 430/111 X
5,232,806 8/1993 Yamada et al. ..... 430/106.6

FOREIGN PATENT DOCUMENTS 1-221757 9/1989 Japan .
3-155562 7/1991 Japan .

*Primary Examiner*—Roland Martin
*Attorney, Agent, or Firm*—Oliff & Berridge

[57] ABSTRACT

A magnetic toner comprising a binder resin having dispersed therein a magnetic powder is disclosed, wherein the magnetic toner has a volume average particle diameter ($D_{50}$) of from 4 to 9 μm, the magnetic powder has a number average particle diameter of from 0.15 to 0.25 μm (hereinafter simply referred to as a particle diameter), a BET specific surface area of from 6 to 8 $m^2/g$, and a residual magnetization of from 7 to 10 emu/g, the magnetic powder is present in an amount of from 30 to 70% based on the total weight of the magnetic toner, and the magnetic toner has adhered to the surface thereof silica powder having been rendered hydrophobic. The magnetic toner exhibits superior performance in terms of image density, definition, dot and fine line reproducibility, and environmental stability.

20 Claims, No Drawings

MAGNETIC TONER

FIELD OF THE INVENTION

This invention relates to a magnetic toner for development of an electrostatic latent image. More particularly, it relates to a magnetic toner suitable to an image formation system including a step of carrying a thin film of a toner on a toner carrier to a developing zone, a step of fixing a toner image by heating by means of a heat fixing mechanism, such as a heat roll, and a step of cleaning the toner carrier.

BACKGROUND OF THE INVENTION

In the field of electrostatic image formation using a dry developer, studies have been directed to reduction of toner particle size aiming at achievement of development of a finer electrostatic latent image with high reproducibility. However, mere reduction in toner particle size tends to cause adhesion of the toner onto the background area, called fog. In order to solve this problem, a toner satisfying the relation 3.7–0.11d ≦ or ≦6.5–0.23d has been proposed, wherein d is a volume average diameter of a toner and or is a residual magnetization, has been proposed as disclosed in JP-A-1-221757 (the term "JP-A" as used herein means an "unexamined published Japanese patent application").

According to the above-mentioned technique, the image density is increased to some extent, and fine line reproducibility, gradation, and resistance to fog can be improved. However, as the particle size of a toner is decreased, the magnetic force is increased. As a result, the magnetic cohesive force increases, which is unfavorable for obtaining high definition. Therefore, the technique no more meets the latest strict demands for high image quality such as a high image density o at least 1.4, and preferably around 1.5, as measured with a reflection densitometer, excellent fine line reproducibility, excellent gradation, and freedom from fog. Additionally, the content of a magnetic substance in the toner is increased as compared with conventional toners so as to increase the magnetic force while reducing the size of the toner. However, an increase in magnetic substance content results in an increase in toner specific gravity. It follows that the requisite amount of the toner per copy, that is, a toner consumption will increase, which is against resources saving. Further, a latent image carrier is easily abraded during a cleaning step, tending to have reduced durability. Furthermore, toner fixing properties tend to be deteriorated with an increase of magnetic substance in content.

Hence, improvements have been added to a magnetic substance per se. For example, JP-A-3-155562 teaches a toner having a volume average particle size of not greater than 10 μm in which a hexagonal magnetic substance having a particle size of from 0.1 to 0.3 m is used. Since the toner particles have a moderately uneven surface due to projections of the magnetic substance, the chargeability of the toner is easy to control, and the toner is excellent in environmental stability and durability. However, the toner is still insufficient for meeting such high demands as high reproducibility in developing a very fine latent image of 600 dpi (dot per inch) or 800 dpi, a high image density of about 1.5 as measured with a reflection densitomer, and freedom from fog.

It is now deemed important to develop a magnetic toner while minimizing the magnetic substance content. The confronting problem resides in that mere reduction in magnetic substance content leads to various disadvantages in addition to fog. For example, the quantity of charge would increase more than necessary to cause charge-up phenomena, that is, a reduction in image density and fogging particularly in a low temperature and low humidity environment. Further, the effect of the toner on polishing the surface of a latent image carrier would be lessened, tending to cause image disturbances, such as a smeared image due to contaminants generated by a charger.

JP-A-2-284158 proposes a toner having a chargeability of from —20 to —35 C/g. Although this toner succeeds in inhibiting image density reduction attributed to an increased charge quantity by charge-up phenomena during copying, it is still insufficient for meeting such high demands for image quality as high definition, high reflection density of about 1.5, and freedom from fog, similarly o the toner disclosed in JF-A-3-155562.

As discussed adore, none of the conventional toners satisfies the strict demands o image quality, and they are not always satisfactory in other performance properties.

SUMMARY OF THE INVENTION

An object of the present invention is to provide a magnetic toner having high resolving power.

Another object of the present invention is to provide a magnetic toner having excellent dot and fine line reproducibility.

A further object of the present invention is to provide a magnetic toner providing a high image density with sufficiently broad anti-fog latitude.

A still further object of the present invention is to provide a magnetic toner which can develop a digital latent image with high reproducibility and excellent gradation.

A yet further object of the present invention is to provide a magnetic toner which is not dependent on the environment, causing no problem particularly in a low temperature and low humidity environment.

An additional object of the present invention is to provide a magnetic toner which can provide a high image density even if the content of a magnetic powder is not increased and the toner consumption is small.

A still additional object of the present invention is to provide a magnetic toner wherein a latent image carrier is moderately abraded and a smeared image and toner fusion are not caused.

As a result of extensive investigations, the present inventors have found that the above objects are accomplished by a magnetic toner having a specific particle size and containing, in a specific proportion, a magnetic powder having a specific particle size, a specific BET specific surface area and a specific residual magnetization, in which silica powder having been rendered hydrophobic (hereinafter referred to as hydrophobic silica powder) is adhered to the surface of the toner. The present invention has been completed based on this finding.

The present invention relates to a magnetic toner comprising a binder resin having dispersed therein a magnetic powder, wherein the magnetic toner has a volume average particle diameter ($D_{50}$) of from 4 to 9 μm, the magnetic powder has a number average particle diameter of from 0.15 to 0.25 μm (hereinafter simply referred to as a particle diameter), a BET specific surface area of from 6 to 8 $m^2/g$, and a residual magnetization of from 7 to 10 emu/g, the magnetic powder is present in an amount of from 30 to 70% based on the total weight of the magnetic toner, and the magnetic toner has adhered to the surface thereof silica powder having been rendered hydrophobic.

In a preferred embodiment of the present invention, the absolute quantity of charge of the toner is from 30 to 60 μC/g.

In another preferred embodiment of the present invention, the amount of the silica powder adhering to the surface of the toner with weak force is not more than 0.35% by weight based on the toner, and the sum of the amount of the hydrophobic silica powder adhering to the surface of the toner with medium force and that of the hydrophobic silica powder adhering to the surface of the toner with weak force is not less than 0.25% by weight based on the toner.

DETAILED DESCRIPTION OF THE INVENTION

The magnetic powder which can be used in the present invention is not limited, and any known magnetic substance can be employed. Suitable magnetic substances include metals, such as iron, cobalt, and nickel; alloys of these metals; metal oxides, such as $Fe_3O_4$, $\gamma$-$Fe_2O_3$, and Co-doped iron oxide; and various ferrites, such as MnZn ferrite and NiZn ferrite. These magnetic powders can be prepared in a known manner.

In order to accomplish the objects of the present invention, the magnetic powder to be used should have a specific particle diameter, a specific residual magnetization and a specific BET specific surface area, and the content of such magnetic powder in the magnetic toner should be specifically controlled.

The magnetic powder should have a particle diameter (arithmetic mean) ranging from 0.15 to 0.25 μm, and preferably from 0.18 to 0.23 μm. If the magnetic powder is smaller than 0.15 μm, it has insufficient dispersibility in a binder resin, resulting in reductions in image density and image density retention. If it exceeds 0.25 μm, fog tends to occur in a low temperature and low humidity environment (in the present specification, it simulates winter environment), and a latent image carrier tends to be worn down to have a reduced life.

The magnetic powder should have a BET specific surface area ranging from 6 to 8 $m^2/g$, and preferably from 6.2 to 7.8 $m^2/g$. If the BET specific surface area is less than 6 $m^2/g$ the toner tends to cause fog particularly in a low temperature and low humidity environment (in the present specification, it simulates summer environment) and undergo deterioration in dot and fine line reproducibility. If it exceeds 8 $m^2/g$, the image density in a high temperature and high humidity environment is reduced, and toner scattering occurs.

The magnetic powder should have a residual magnetization ($\sigma r$) ranging from 7 to 10 emu/g, preferably from 7.5 to 9.4 emu/g, and more preferably from 7.7 to 9.2 emu/g. If the residual magnetization is less than 7 emu/g, the anti-fog latitude would be narrowed. If it exceeds 10 emu/g, the resolving power would be reduced, resulting in poor gradation in developing a digital latent image.

The content of the magnetic powder in the toner should fall within a range of from 30 to 70% by weight, preferably from 30 to 60% by weight, and more preferably from 35 to 45% by weight based on the toner. If the content is less than 30% by weight, fog would occur particularly in a low temperature and low humidity environment, and the developability would be non-uniform. If it exceeds 70% by weight, the image density in a high temperature and high humidity environment becomes insufficient, the fixing properties in a low temperature and low humidity environment tends to be insufficient, and wear of a latent image carrier would be considerable.

While not limiting, magnetic powder having a hexagonal shape is preferred because it has a smaller residual magnetization and therefore weaker magnetic cohesiveness than needle-like or octagonal powder and produces a greater polishing effect on a latent image carrier than spherical powder so as to clean the latent image carrier of the contaminants. While the reason for such advantages possessed by hexagonal powder are not clear, it seems that hexagonal powder exhibits good dispersibility in a binder resin to provide a toner having a uniform internal structure.

It is very effective for fog prevention to incorporate sulfur into the magnetic powder. Sulfur is suitably added in an amount of from 0.05 to 0.25% by weight, preferably from 0.1 to 0.25% by weight, and more preferably from 0.12 to 0.23% by weight, based on the magnetic powder. Sulfur added in this amount is effective to prevent fog or toner scatter around an image area in a low temperature and low humidity .environment or reduction of resolving power. While the mechanism of action of sulfur has not yet been elucidated, it appears that the negative chargeability of sulfur increases chargeability of the magnetic powder thereby making the chargeability of the toner uniform.

The binder resin which can be used in the present invention is not limited, and any binder resin conventionally employed in magnetic toners is usable. Illustrative examples of suitable binder resins include homopolymers of a vinyl monomer and copolymers of two or more vinyl monomers. Typical vinyl monomers include styrene, p-chlorostyrene, vinylnaphthalene, ethylenically unsaturated monoolefins (e.g., ethylene, propylene, butylene and isobutylene), vinyl halides (e.g., vinyl chloride, vinyl bromide, and vinyl fluoride), vinyl esters (e.g., vinyl acetate, vinyl propionate, vinyl benzoate, vinyl butyrate, vinyl formate, vinyl stearate, and vinyl caproate), ethylenically unsaturated monocarboxylic acids and esters thereof (e.g., methyl acrylate, ethyl acrylate, n-butyl acrylate, isobutyl acrylate, dodecyl acrylate, n-octyl acrylate, 2-chloroethyl acrylate, phenyl acrylate, methyl α-chloroacrylate, methyl methacrylate, ethyl methacrylate, and butyl methacrylate), ethylenically unsaturated monocarboxylic acid derivatives (e.g., acrylonitrile, methacrylonitrile, and acrylamide), ethylenically unsaturated carboxylic acids and esters thereof (e.g., dimethyl maleate, diethyl maleate, and dibutyl maleate), vinyl ketones (e.g., vinyl methyl ketone, vinyl hexyl ketone, and methyl isopropenyl ketone), vinyl ethers (e.g., vinyl methyl ether, vinyl isobutyl ether, and vinyl ethyl ether), vinylidene halides (e.g., vinylidene chloride and vinylidene chlorofluoride), and N-vinyl compounds (e.g., N-vinylpyrrole, N-vinylcarbazote, N-vinylindole, and N-vinylpyrroline).

Of them, stylene, ethylenically monocarboxylic acids and esters thereof, stylene-ethylenically monocarboxylic acid ester copolymers and polyesters are preferred.

The above-mentioned binder resins preferably comprise a low-molecular weight component having a molecular weight peak between 3,000 and 7,000 and a high-molecular weight component having a molecular weight peak between 200,000 and 1,000,000. With the molecular weight peak of the low-molecular weight component falling within the above range, problems which may arise from improper selection of a binder resin, such as hot offset, insufficient heat resistance, blocking, and insufficient storage stability, tend to be avoided. Additionally, reduction in crease characteristics of a fixed toner image or insufficient grindability in toner preparation hardly occur. With the molecular weight peak of the high-molecular weight component falling within the above range, the toner tends to be prevented from causing hot offset and suffering from reduction in durability due to insufficient dispersibility of the magnetic powder or a charge control agent. In addition, crease characteristics of a fixed toner image would not be reduced even in making 1,000,000 or more copies.

A preferred ratio of the molecular weight peak area of the low-molecular weight component to that of the high-molecular weight component is from 65/35 to 85/15. With the area ratio of the molecular weight peak of the low-molecular weight component being within the above range, such problems as hot offset, non-visual offset (hereinafter abbreviated as NVO), poor dispersibility of magnetic powder, and reduction in crease characteristics hardly arise. With the area ratio of the molecular weight peak of the high-molecular weight component being within the range of from 15 to 35%, such problems as hot offset, NVO, reduction in crease characteristics, and poor grindability in toner preparation hardly occur.

Binder resins having a melt index (MI) of from 10 to 20 are suitable because such binder resins exclude the problems of crease characteristics, dispersibility of magnetic powder, and hot offset.

It is essential that hydrophobic silica powder is externally added to the magnetic toner and adhered to the surface thereof. The amount of the hydrophobic silica powder to be added is appropriately selected and preferably ranges from 0.5 to 5% by weight based on the toner.

Treatment for rendering silica powder hydrophobic is carried out by using a known treating agent. For preference, silica particles having a primary particle size of from 5 to 50 nm are treated with a treating agent, such as silicone oil, dimethyldichlorosilane or hexamethyldisilazane. External addition of the hydrophobic silica powder to the surface of the magnetic toner is effective to prevent the magnetic toner from deteriorating the fluidity and from adhering to a photoreceptor thereby maintaining fine line reproducibility for an extended period of time.

The degree and amount of adhesion of the hydrophobic silica on the magnetic toner have influences on fog and filming of a toner on a latent image carrier. The degree of adhesion as noted in the present invention can be quantitatively expressed in terms of adhesion strength distribution of the silica powder on the magnetic toner surface. The "adhesion strength distribution" can be measured by dispersing a magnetic toner in water in the presence of a surface active agent and detaching the silica powder from the toner surface in two divided stages by varying the intensity of an ultrasonic dispersing machine as hereinafter described in detail. Those silica particles which are detached in the first stage are designated "silica powder adhering with weak force", those which are detached in the second stage are designated "silica powder adhering with medium force", and those which are not detached in the second stage are designated "silica powder adhering with strong force".

The amount of silica powder adhering with weak force is preferably not more than 0.35% by weight, more preferably not more than 0.3% by weight, and most preferably not more than 0.25% by weight, based on the toner. The lower limit of the amount of silica powder adhering with weak force is preferably 0.1% by weight based on the toner. When that amount exceeds 0.35% by weight, cases may sometimes be met with in which the image density is reduced during copying under a high temperature and high humidity condition after long-term suspension of the copying machine, or the silica powder adhering to a latent image carrier tends to become a nucleus to fuse the toner particles to each other under a low temperature and low humidity condition.

It is preferable that the sum of the amount of the silica powder adhering with medium force and that of the silica powder adhering with weak force is not less than 0.25% by weight, more preferably from 0.3 to 2.0% by weight, and most preferably not less than 0.35% by weight, based on the toner. The upper limit of the sum is preferably 0.6% by weight based on the toner. With that sum being less than 0.25% by weight, there is a tendency that the toner particles have an increased cohesive force, failing to produce sufficient frictional charges by means of a charge-imparting members, such as a toner carrier. As a result, the toner may have an insufficient quantity of charge and readily cause fog. Additionally, such problems as a reduction in image density in a high temperature and high humidity environment, a reduction in heat resistance, and deterioration of antiblocking properties tend to arise.

If desired, the magnetic toner of the present invention may contain additives, such as a charge control agent and a parting agent.

Suitable charge control agents include fluorine-containing surface active agents, metal-containing dyes, such as salicylic acid-metal complexes and azo type metallic compounds, high-molecular weight acids, such as copolymers containing a maleic acid monomer unit, quaternary ammonium salts, azine dyes, such as nigrosine, and carbon black.

The charge control agents may be used in an amount of 0.01 to 10 wt % based on the toner.

Suitable parting agents include paraffins having 8 or more carbon atoms, such as paraffin wax, paraffin latex, and microcrystalline wax; and polyolefins, such as low-molecular weight polypropylene, and low-molecular weight polyethylene.

The parting agents may be used in an amount of 0.01 to 30 wt % based on the toner.

For the purpose of improving durability, fluidity or cleanability of the magnetic toner, the magnetic toner may further contain inorganic fine powders, such as silica, organic fine powders, such as fat%y acids and derivatives or metal salts thereof, and fluorine-containing resin fine particles.

The fine powders except for silica may be used in an amount of 0.01 to 30 wt % based on the toner.

The magnetic toner of the present invention can be prepared by kneading the above-mentioned magnetic powder, binder resin, and necessary additives, such as a charge control agent and a parting agent, under heating, cooling the mixture, and grinding the mixture followed by classification to obtain toner particles and then externally adding thereto the above-mentioned hydrophobic silica powder.

The thus prepared magnetic toner should have a volume average particle diameter ($D_{50}$) ranging from 4 to 9 μm, preferably from 5 to 8 μm, and more preferably from 6 to 8 μm. A magnetic toner having a $D_{50}$ of less than 4 μm will fail to form a satisfactory thin film on a toner carrier and cause a reduction in image density. If it exceeds 9 μm, such a high definition la%en image as having 600 dpi or 800 dpi is hardly developed with high reproducibility.

The magnetic toner of the present invention preferably has an MI of from 10 to 40, more preferably from 15 to 35, and most preferably from 20 to 30. If the MI is less than 10, the fixed toner image tends to have insufficient crease characteristics, and the magnetic powder tends to have poor dispersibility. A magnetic toner having an MI of higher than 30 tends to cause hot offset and background fog.

It is preferable that the absolute charge quantity of the magnetic toner be set between 30 μC/g and 60 μC/g, more preferably 35 and 55 μC/g, and most preferably 45 and 55 μC/g. If the absolute charge quantity is less than 30 μC/g, the toner is apt to cause fog and to provide an insufficient image density. If it exceeds 60 μC/g, the toner tends to cause a reduction in image density, fog, scatter, and ghost development particularly due to charge-up in a low temperature and low humidity environment.

The magnetic toner of the present invention is preferably charged negative.

In the present invention, various properties of the magnetic powder, binder resin, and magnetic toner were measured in accordance with the following methods.

1) Particle Diameter of Magnetic Powder:

An electron micrograph was taken of magnetic powder with a transmission electron microscope at a magnification of 9000, and the diameter of each of randomly selected particles was measured to obtain an arithmetic mean.

2) Residual Magnetization:

Measured with "VSM P-7 Model" manufactured by Toei Kogyosha in a magnetic field of 10 KOe.

3) Degree and Amount of Adhesion of Hydrophobic Silica Powder on Magnetic Toner Surface:

A magnetic toner was dispersed in a water having dissolved therein a surface active agent (Triton, Produced by Wako Chemical). An ultrasonic vibrator (oscillation frequency: 20 kHz) was placed in the dispersion, and silica powder was made to detach from the magnetic toner particles at an output of 20 W for 1 minute (first stage detachment) or at an output of 60 W for 30 minutes (second stage detachment). The solid matter collected by filtration was washed with water and subjected to centrifugation to collect the toner particles. The amount of silica powder remaining on the surface of the toner particles after the first detachment ($W_1$) and that after the second detachment ($W_2$) were determined by X-rays fluorescence analysis. The difference between the amount of silica initially present ($W_0$) and $W_1$ is the amount of silica powder adhering with weak force. The difference between $W_0$ and ($W_1$+$W_2$) is the amount of silica powder adhering with medium force. $W_2$ is the amount of silica powder adhering with strong force. The thus obtained values ($W_0$–$W_1$), [$W_0$–($W_1$+$W_2$)], and $W_2$ in terms of percent by weight based on the toner indicate the distribution of adhesion strength of silica powder.

4) Molecular Weight Distribution of Binder Resin:

Measured by gel-permeation chromatography under the following conditions:

Chromatograph: "HLC 802A Model" manufactured by Toso Co., Ltd.

Column: two columns "GMH 6" connected in series

Temperature: 40° C.

Solvent: tetrahydrofuran

Flow rate: 1.0 ml/min

Sample concentration: 0.5% by weight

Amount of injected sample: 200 μl

5) Area Ratio of Molecular Weight Peak of Low-Molecular Weight Component to Molecular Weight Peak of High-Molecular Weight Component:

Mountains having the respective peak in molecular weight distribution were divided at both the bottom points of the respective valleys, and the peak area of each mountain was calculated to obtain the peak area ratio.

6) MI of Binder Resin:

Measured in accordance with the method specified in JIS (150° C., 2.16 kg load).

7) Particle Size of Magnetic Toner:

Measured with a Coulter counter "TA-II" manufactured by Coulter Counter Co. at an aperture of 100 μm.

8) MI of Magnetic Toner:

Measured in accordance with the method specified in JIS (150° C., 2.16 kg load).

9) Charge Quantity of Magnetic Toner:

A magnetic toner was mixed with steel shots (diameter: 100 μm) as a carrier in a tumbler blender for 25 seconds to prepare a two-component developer having a toner concentration of 3% by weight. After the mixing, the charge quantity of the developer was measured with "TB-500" manufactured by Toshiba Chemical Co., Ltd. according to a blow-off method.

10) Crease Characteristics of Fixed Image (Folding characteristics of fixed image; index of fixing properties of image):

A fixed toner image having a density of about 1.4 to 1.5 and a diameter of about 20 mm was once folded and then opened. The image at the fold was lightly rubbed with cotton. The width (μm) of the image which disappeared on rubbing was taken as an index of crease characteristics of the fixed image, which is indicative of the fixing properties of the toner. The smaller the width, the more satisfactory the fixing properties.

The present invention will now be illustrated in greater detail with reference to Examples, but it should be understood that the present invention is not construed as being limited thereto. All the parts and percents are given by weight unless otherwise noted.

EXAMPLE 1

| | |
|---|---|
| Styrene-n-butyl acrylate copolymer (Mw: 140,000; MI: 14; Tg: 55° C.) | 57 parts |
| Magnetic powder (hexagonal magnetite; particle diameter: 0.19 μm; BET specific surface area: 7.0 $m^2$/g; σr: 8.4 emu/g; Sulfur content: 0.15%) | 40 parts |
| Negative charge control agent (azo type Cr dye) | 1 part |
| Low-molecular weight polypropylene | 2 parts |

The above styrene-n-butyl acrylate copolymer showed molecular weight peaks of 4,500 and 600,000 with the low-molecular weight component to high-molecular weight component ratio being 75:25.

The above components were dry blended in a Henschel mixer and melt-kneaded in an extruder at 140° C. After cooling, the mixture was coarsely ground and then pulverize, followed by classification to obtain grands having a volume average particle diameter ($D_{50}$) of 6.0 μm. The grinds were further classified to obtain grinds having a $D_{50}$ of 7.3 μm containing 30% of particles of not greater than 5.0 μm. The powder was mixed with 1.0% of silicone oil-treated colloidal silica fine powder in a Henschel mixer to prepare a magnetic toner having an MI of 28. The charge quantity (Q/M) of the magnetic toner was −55 μC/g. The amount of =he silica powder adhering with weak force was 0.23%, and the sum of the amount of the silica powder adhering with weak force and that adhering with medium force was 0.75%.

The resulting magnetic toner was evaluated by a running test on a printer "XP-15" manufactured by Fuji Xerox Co., Ltd. modified so as to have a printing speed increased from 15 copies/min to 20 copies/min and a definition set at 600 dpi.

When about 30,000 copies were taken in a high temperature and high humidity environment (hereinafter 32° C., 85% R.H.) or a low temperature and low humidity environment (hereinafter, 10° C., 15% R.H.), the image density was substantially constant at about 1.5, the resolving power and gradation were satisfactory, and no background stains occurred. The index of crease characteristics was 53, indicating satisfactory fixing properties. The toner consumption at an image area ratio of 5% was as low as about 35 mg/A4 in average.

EXAMPLE 2

| | |
|---|---|
| Styrene-n-butyl acrylate copolymer (Mw: 210,000; MI: 11; Tg: 60° C.) | 51.5 parts |
| Magnetic powder (octagonal magnetite; particle diameter: 0.22 μm; BET specific surface area: 6.5 $m^2/g$; σr: 8.1 emu/g; Sulfur content: 0.18%) | 45 parts |
| Negative charge control agent (salicylic acid type Cr dye) | 1.5 parts |
| Low-molecular weight polypropylene | 2 parts |

The above styrene-n-butyl acrylate copolymer showed molecular weight peaks of 4,700 and 580,000 with the low-molecular weight component to high-molecular weight component ratio of 73:27.

The above components were dry blended in a Henschel mixer and melt-kneaded in an extruder at 135° C. After cooling, the mixture was coarsely ground and then pulverized, followed by classification to obtain grinds having a $D_{50}$ of 6.5 μm. The grinds were further classified to obtain grinds having a $D_{50}$ of 7.0 μm containing 35% of particles of not greater than 5.0 μm. The powder was mixed with 0.5% of dimethyldichlorosilane-treated colloidal silica fine powder in a Henschel mixer to prepare a magnetic toner having an MI of 25. The charge quantity (Q/M) of the magnetic toner was −50 μC/g. The amount of the silica powder adhering with weak force was 0.10%, and the sum of the amount of the silica powder adhering with weak force and that adhering with medium force was 0.68%.

The resulting magnetic toner was evaluated by a running test on a copying machine "FX 5030" manufactured by Fuji Xerox Co., Ltd. modified to a digital copying machine having a definition of 600 dpi and having a developing mechanism for a one-component developer.

When about 70,000 copies were taken in a high temperature and high humidity environment or a low temperature and low humidity environment, the image density was substantially between 1.45 and 1.50, the resolving power and gradation were satisfactory, and no background stains occurred. The index of crease characteristics was 53, indicating satisfactory fixing properties. The toner consumption at an image area ratio of 5% was as low as about 37 mg/A4 in average.

EXAMPLE 3

| | |
|---|---|
| Polyester (bisphenol A/terephthalic acid-based condensate; MI: 19; Tg: 60° C.) | 47 parts |
| Magnetic powder (hexagonal magnetite; particle diameter: 0.18 μm; BET specific surface area: 7.5 $m^2/g$; σr: 8.7 emu/g; Sulfur content: 0.2%) | 50 parts |
| Negative charge control agent (azo type Fe dye) | 1 part |
| Low-molecular weight polypropylene | 2 parts |

The above component were dry blended in a Henschel mixer and melt-kneaded in an extruder a 135° C. After cooling, the mixture was coarsely ground and hen pulverized, followed by classification to obtain grinds having a $D_{50}$ of 6.0 μm. The grinds were further classified to obtain grands having a $D_{50}$ of 6.5 μm and containing 40% of particles of not greater than 5.0 μm. The powder was mixed with 1.0% of silicone oil-treated colloidal silica fine powder in a Henschel mixer to prepare a magnetic toner having an MI of 35.

The resulting magnetic toner was evaluated by a running test on a copying machine "Vivace 500" manufactured by Fuji Xerox Co., Ltd. modified to a digital copying machine having a definition of 400 dpi and having a developing mechanism for a one-component developer.

When about 400,000 copies were taken in a high temperature and high humidity environment or a low temperature and low humidity environment, the image density was substantially between 1.47 and 1.50, the resolving power and gradation were satisfactory, and no background stains occurred. The index of crease characteristics was 53, indicating satisfactory fixing properties. The toner consumption at an image area ratio of 5% was as low as about 40 mg/A4 in average.

EXAMPLE 4

| | |
|---|---|
| Styrene-n-butyl acrylate copolymer (Mw: 200,000; MI: 17; Tg: 58° C.) | 56 parts |
| Magnetic powder (hexagonal magnetite; particle diameter: 0.2 μm; BET specific surface area: 7.0 $m^2/g$; σr: 8.9 emu/g) | 40 parts |
| Negative charge control agent (azo type Cr dye) | 0.9 parts |
| Polypropylene wax | 3.1 parts |

The above styrene-n-butyl acrylate copolymer showed molecular weight peaks of 4,800 and 620,000 with the low-molecular weight component to high-molecular weight component ratio of 74:26:

The above components were dry blended in a Henschel mixer and melt-kneaded in an extruder at 150° C. After cooling, the mixture was coarsely ground and then pulverized, followed by classification to obtain grinds having a $D_{50}$ of 6.6 μm. The grinds were further classified to obtain grinds having a $D_{50}$ of 7.2 μm. The powder was blended with 1.0 part of hexamethyldisilazane-treated colloidal silica fine powder in a Henschel mixer at the blade tip speed of 20 m/sec for 20 minutes to adhere the hydrophobic colloidal silica powder to the surface of the toner particles. The quantity (Q/M) of the resulting magnetic toner was −50 μC/g.

The resulting magnetic toner was evaluated by a running test on a printer "XP-15" modified model. The results obtained are shown in Table 1 below.

EXAMPLE 5

| | |
|---|---|
| Styrene-n-butyl acrylate copolymer (Mw: 200,000; MI: 19; Tg: 57° C.) | 61 parts |
| Magnetic powder (hexagonal magnetite; particle diameter: 0.25 μm; BET specific surface area: 6.3 $m^2/g$; σr: 7.6 emu/g) | 35 parts |
| Negative charge control agent (azo type Fe dye) | 0.9 parts |
| Polypropylene wax | 3.1 parts |

The above styrene-n-butyl acrylate copolymer showed molecular weight peaks of 5,000 and 650,000 with the low-molecular weight component to high-molecular weight component ratio of 70:30.

The above components were dry blended in a Henschel mixer and melt-kneaded in an extruder at 150° C. After cooling, the mixture was coarsely ground and then pulverized, followed by classification to obtain grinds having a $D_{50}$ of 7.5 μm. The grinds were further classified to obtain grinds having a $D_{50}$ of 8.0 μm. The powder was mixed with 0.7 part of silicone oil-treated colloidal silica fine powder in a Henschel mixer for 20 minutes at the blade tip speed of 20 m/sec to adhere the hydrophobic colloidal silica powder to the surface of the toner particles. The quantity (Q/M) of the resulting magnetic toner was −40 μC/g.

The resulting magnetic toner was evaluated in the same manner as in Example 4. The results obtained are shown in Table 1 below.

EXAMPLE 6

| | |
|---|---|
| Styrene-n-butyl acrylate copolymer (Mw: 200,000; MI: 13; Tg: 61° C.) | 51 parts |
| Magnetic powder (hexagonal magnetite; particle diameter: 0.17 μm; BET specific surface area: 8.0 $m^2/g$; σr: 9.6 emu/g) | 45 parts |
| Negative charge control agent (azo type Zn dye) | 0.9 parts |
| Polypropylene wax | 3.1 parts |

The above styrene-n-butyl acrylate copolymer showed molecular weight peaks of 3,900 and 550,000 with the low-molecular weight component to high-molecular weight component ratio of 80:20.

The above components were dry blended in a Henschel mixer and melt-kneaded in an extruder at 150° C. After cooling, the mixture was coarsely ground and then pulverized, followed by classification to obtain grinds having a $D_{50}$ of 4.4 μm. The grinds were further classified to obtain grinds having a $D_{50}$ of 5.0 μm. The powder was mixed with 1 parts of silicone oil-treated colloidal silica fine powder in a Henschel mixer at the blade tip speed of 20 m/sec for 20 minutes to adhere the hydrophobic colloidal silica powder to the surface of the toner particles. The quantity (Q/M) of the resulting magnetic toner was −55 μC/g.

The resulting magnetic toner was evaluated in the same manner as in Example 4. The results obtained are shown in Table 1 below.

Comparative Example 1

| | |
|---|---|
| Styrene-n-butyl acrylate copolymer (Mw: 200,000; MI: 17; Tg: 58° C.) | 56 parts |
| Magnetic powder (hexagonal magnetite; particle diameter: 0.12 μm; BET specific surface area: 10.5 $m^2/g$; σr: 12 emu/g) | 40 parts |
| Negative charge control agent (azo type Cr dye) | 0.9 parts |
| Polypropylene wax | 3.1 parts |

The above styrene-n-butyl acrylate copolymer showed molecular weight peaks of 4,800 and 620,000 with the low-molecular weight component to high-molecular weight component ratio of 74:26.

The above components were dry blended in a Henschel mixer and melt-kneaded in an extruder at 150° C. After cooling, the mixture was coarsely ground and then pulverized, followed by classification to obtain grinds having a $D_{50}$ of 6.5 μm. The grinds were further classified to obtain grinds having a $D_{50}$ of 7.1 μm. The powder was mixed with 1.0 part of silicone oil-treated colloidal silica fine powder in a Henschel mixer at the blade tip speed of 20 m/sec for 20 minutes to adhere the hydrophobic colloidal silica powder to the surface of the toner particles. The quantity (Q/M) of the resulting magnetic toner was −44 μC/g.

The resulting magnetic toner was evaluated in the same manner as in Example 4. The results obtained are shown in Table 1 below.

Comparative Example 2

| | |
|---|---|
| Styrene-n-butyl acrylate copolymer (Mw: 200,000; MI: 17; Tg: 58° C.) | 56 parts |
| Magnetic powder (hexagonal magnetite; particle diameter: 0.30 μm; BET specific surface area: 5.0 $m^2/g$; σr: 6 emu/g) | 40 parts |
| Negative charge control agent (azo type Cr dye) | 0.9 parts |
| Polypropylene wax | 3.1 parts |

The above styrene-n-butyl acrylate copolymer showed molecular weight peaks of 4,800 and 620,000 with the low-molecular weight component to high-molecular weight component ratio of 74:26.

The above components were dry blended in a Henschel mixer and melt-kneaded in an extruder at150° C. After cooling, the mixture was coarsely ground and then pulverized, followed by classification to obtain grinds having a $D_{50}$ of 6.4 μm. The grinds were further classified to obtain grinds having a $D_{50}$ of 7.0 μm. The powder was mixed with 1.0 part of silicone oil-treated colloidal silica fine powder in a Henschel mixer at the blade tip speed of 20 m/sec for 20 minutes to adhere the hydrophobic colloidal silica powder to the surface of the toner particles. The quantity (Q/M) of the resulting magnetic toner was −44 μC/g.

The resulting magnetic toner was evaluated in the same manner as in Example 4. The results obtained are shown in Table 1 below. Fog resistance and Definition was evaluated by a sample chart.

TABLE 1

| Example No. | Initial Image Quality: Image Density | Fog Resistance | Definition | Image Defect | Image Quality After Taking 20,000 Copies: Image Density | Fog Resistance | Definition | Image Defect |
|---|---|---|---|---|---|---|---|---|
| Example 4 | 1.49 | excellent | excellent | none | 1.46 | excellent | excellent | none |
| Example 5 | 1.46 | excellent | excellent | none | 1.45 | excellent | excellent | none |
| Example 6 | 1.50 | excellent | excellent | none | 1.42 | good | excellent | none |
| Compar. Example 1 | 1.45 | excellent | acceptable | none | 1.39 | acceptable | poor | none |
| Compar. Example 2 | 1.44 | acceptable | good | none | 1.40 | poor | acceptable | none |

EXAMPLE 7

| | |
|---|---|
| Styrene-n-butyl acrylate copolymer (Mw: 130,000; MI: 15; Tg. 58° C.) | 57.3 parts |
| Magnetic powder (hexagonal magnetite; particle diameter: 0.19 μm; BET specific surface area: 7 $m^2/g$; σr: 8.4 emu/g; Sulfur content: 0.15%) | 40 parts |
| Negative charge control agent (azo type Cr dye) | 0.7 parts |
| Low-molecular weight polypropylene | 2.1 parts |

The above styrene-n-butyl acrylate copolymer showed molecular weight peaks of 3,600 and 510,000 with the low-molecular weight component to high-molecular weight component ratio of 73:27.

The above components were dry blended in a Henschel mixer and melt-kneaded in an extruder at 140° C. After cooling, the mixture was coarsely ground and then pulverised, followed by classification calon to obtain grinds having a $D_{50}$ of 6.5 μm. The grinds were further classified to obtain grinds having a $D_{50}$ of 7.3 μm and containing 30% of particles of not greater than 5.0 μm. The powder was mixed with 1.0% of silicone oil-treated colloidal silica fine powder in a Henschel mixer to prepare a magnetic toner having an MI of 30 and a charge quantity (Q/M) of −50 μC/g. The amount of the silica powder adhering with weak force was 0.10%, and the sum of the amount of the silica powder adhering with weak force and that adhering with medium force was 0.80%.

The resulting magnetic toner was evaluated by a running test on a printer "XP-15" modified so as to have a printing speed increased from 15 copies/min to 20 copies/min and a definition set at 600 dpi.

When about 30,000 prints were taken in a high temperature and high humidity environment or a low temperature and low humidity environment, the image density was substantially between 1.48 and 1.52, the resolving power and gradation were satisfactory, and no background stains occurred. The index of crease characteristics was 40, indicating satisfactory fixing properties. The toner consumption at an image area ratio of 5% was as low as about 37 mg/A4 in average.

EXAMPLE 8

| | |
|---|---|
| Styrene-n-butyl acrylate copolymer (Mw: 200,000; MI: 12; Tg: 60° C.) | 50.9 parts |
| Magnetic powder (octagonal magnetite; particle diameter: 0.22 μm; BET specific surface area: 6.5 $m^2/g$; σr: 8.1 emu/g) | 45 parts |
| Negative charge control agent (salicylic acid type Cr dye) | 2 parts |
| Low-molecular polypropylene | 2.1 parts |

The above styrene-n-butyl acrylate copolymer showed molecular weight peaks of 4,200 and 580,000 with the low-molecular weight component to high-molecular weight component ratio of 77:22.

The above components were dry blended in a Henschel mixer and melt-kneaded in an extruder at 135° C. After cooling, the mixture was coarsely ground and then pulverized, followed by classification to obtain grinds having a $D_{50}$ of 6.0 μm. The grinds were further classified to obtain grinds having a $D_{50}$ of 6.8 μm and containing 35% of particles of not greater than 5.0 μm. The powder was mixed with 0.5% of dimethyldichloromethane-treated colloidal silica fine powder in a Henschel mixer to prepare a magnetic toner having an MI of 25 and a charge quantity (Q/M) of −46 μC/g. The amount of the silica powder adhering with weak force was 0.10%, and the sum of the amount of the silica powder adhering with weak force and that adhering with medium force was 0.70%.

The resulting magnetic toner was evaluated by a running test on a copying machine "FX 5030" modified to a digital copying machine having a definition of 600 dpi and a developing mechanism for a one-component developer.

When about 100,000 copies were taken in a high temperature and high humidity environment or a low temperature and low humidity environment, the image density was substantially between 1.46 and 1.50, the resolving power and gradation were satisfactory, and no background stains occurred. The index of crease characteristics was 60, indicating satisfactory fixing properties. The toner consumption at an image area ratio of 5% was as low as about 39 mg/A4 in average.

EXAMPLE 9

| | |
|---|---|
| Polyester (bisphenol A/terephthalic acid-based condensate; MI: 17; Tg: 59° C.) | 47.3 parts |
| Magnetic powder (hexagonal magnetite; particle diameter: 0.18 μm; BET specific surface area: 7.5 $m^2/g$; σr: 8.7 emu/g; Sulfur content: 0.2%) | 50 parts |
| Negative charge control agent (azo type Fe dye) | 0.7 part |
| Low-molecular weight polypropylene | 2 parts |

The above components were dry blended in a Henschel mixer and melt-kneaded in an extruder at 135° C. After cooling, the mixture was coarsely ground and then pulverized, followed by classification to obtain grinds having a $D_{50}$ of 5.7 μm. The grinds were further classified to obtain grinds having a $D_{50}$ of 6.5 μm and containing 40% of particles of not greater than 5.0 μm. The powder was mixed with 1.2% of silicone oil-treated colloidal silica fine powder in a Henschel mixer to prepare a magnetic toner having an MI of 32 and a Q/M of −40 μC/g. The amount of the silica powder adhering with weak force was 0.15%, and the sum of the amount of the silica powder adhering with weak force and that adhering with medium force was 0.80%.

The resulting magnetic toner was evaluated by a running test on a copying machine "Vivace 500" modified to a digital copying machine having a definition of 400 dpi and having a developing mechanism for a one-component developer.

When about 500,000 copies were taken in a high temperature and high humidity environment or a low temperature and low humidity environment, the image density was substantially between 1.45 and 1.52, the resolving power and gradation were satisfactory, and no background stain occurred. The index of crease characteristics was 40, indicating satisfactory fixing properties. The toner consumption at an image area ratio of 5% was as low as about 42 mg/A4 in average.

EXAMPLE 10

| | |
|---|---|
| Styrene-n-butyl acrylate copolymer (Mw: 210,000; MI: 11; Tg: 60° C.) | 56 parts |
| Magnetic powder (octagonal magnetite; particle diameter: 0.22 μm; BET specific surface area: 6.5 $m^2/g$; σr: 8.1 emu/g; Sulfur content: 0.18%) | 40 parts |
| Negative charge control agent (salicylic acid type Cr dye) | 0.9 part |
| Low-molecular weight polypropylene | 3.1 parts |

The above components were dry blended in a Henschel mixer and melt-kneaded in an extruder at 150° C. After cooling, the mixture was coarsely ground and then pulverized, followed by classification to obtain grinds having a $D_{50}$ of 6.5 μm. The grinds were further classified to obtain grinds having a $D_{50}$ of 7.1 μm. The powder was mixed with 1.0 part of silicone oil-treated colloidal silica fine powder in a Henschel mixer at a blade tip speed of 20 m/sec for 10 minutes to adhere the hydrophobic silica powder on the toner particles. The amount of the silica powder adhering with weak force was 0.21% based on the toner, and the sum of the amount of the silica powder adhering with weak force and that adhering with medium force was 0.67% based on the toner.

EXAMPLE 11

The powder having a $D_{50}$ of 7.1 μm prepared in Example 10 was mixed with 0.7 part of hexamethyldisilazane-treated colloidal silica fine powder in a Henschel mixer at a blade tip speed of 20 m/sec for 10 minutes to prepare a magnetic toner having the hydrophobic silica powder adhered on the toner particles. The amount of the silica powder adhering with weak force was 0.15% based on the toner, and the sum of the amount of the silica powder adhering with weak force and that adhering with medium force was 0.49% based on the toner.

EXAMPLE 12

The powder having a $D_{50}$ of 7.1 μm prepared in Example 10 was mixed with 0.4 part of dimethyldichlorosilane-treated colloidal silica fine powder in a Henschel mixer at a blade tip speed of 20 m/sec for 10 minutes to prepare a magnetic toner having the hydrophobic silica powder adhered on the toner particles. The amount of the silica powder adhering with weak force was 0.08% based on the toner, and the sum of the amount of the silica powder adhering with weak force and that adhering with medium force was 0.28% based on the toner.

EXAMPLE 13

The powder having a $D_{50}$ of 7.1 μm prepared in Example 10 was mixed with 1.0 part of silicone oil-treated colloidal silica fine powder in a Henschel mixer at a blade tip speed of 20 m/sec for 5 minutes to prepare a magnetic toner having the hydrophobic silica powder adhered on the toner particles. The amount of the silica powder adhering with weak force was 0.38% based on the toner, and the sum of the amount of the silica powder adhering with weak force and that adhering with medium force was 0.83% based on the toner.

EXAMPLE 14

The powder having a $D_{50}$ of 7.1 μm an prepared in Example 10 was mixed with 0.7 part of silicone oil-treated colloidal silica fine powder in a Henschel mixer a a blade tip speed of 20 m/sec for 3 minutes to prepare a magnetic toner having the hydrophobic silica powder adhered on the toner particles. The amount of the silica powder adhering with weak force was 0.43% based on the toner, and the sum of the amount of the silica powder adhering with weak force and that adhering with medium force was 0.61% based on the toner.

Comparative Example 3

| | |
|---|---|
| Styrene-n-butyl acrylate copolymer (Mw: 210,000; MI: 11; Tg: 60° C.) | 71 parts |
| Magnetic powder (octagonal magnetite; particle diameter: 0.22 μm; BET specific surface area: 6.5 $m^2/g$; σr: 8.1 emu/g; Sulfur content: 0.18%) | 25 parts |
| Negative charge control agent (salicylic acid type Cr dye) | 0.9 part |
| Low-molecular weight polypropylene | 3.1 parts |

The above components were dry blended in a Henschel mixer and melt-kneaded in an extruder at 150° C. After cooling, the mixture was coarsely ground and then pulverized, followed by classification to obtain grinds having a $D_{50}$ of 6.8 μm. The grinds were further classified to obtain grinds having a $D_{50}$ of 7.6 μm. The powder was mixed with 1.0 part of silicone oil-treated colloidal silica fine powder in a Menschel mixer t a blade tip speed of 20 m/sec for 10 minutes to adhere the hydrophobic silica powder on the toner particles. The amount of he silica powder adhering with weak force was 0.18% based on the toner, and the sum of the amount of the silica powder adhering with week force and that adhering with medium force was 0.69% based on the toner.

Comparative Example 4

| | |
|---|---|
| Styrene-n-butyl acrylate copolymer (Mw: 210,000; MI: 11; Tg: 60° C.) | 61 parts |
| Magnetic powder (octagonal magnetite; particle diameter: 0.22 μm; BET specific surface area: 6.5 $m^2/g$; σr: 8.1 emu/g; Sulfur content: 0.18%) | 35 parts |
| Negative charge control agent (salicylic acid type Cr dye) | 0.9 part |
| Low-molecular polypropylene | 3.1 parts |

The above components were dry blended in a Henschel mixer and melt-kneaded in an extruder at 150° C. After cooling, the mixture was coarsely ground and then pulverized, followed by classification to obtain grinds having a $D_{50}$ of 9.2 μm. The grinds were further classified to obtain grinds having a $D_{50}$ of 9.8 μm. The powder was mixed with 1.0 part of silicone oil-treated colloidal silica fine powder in a Henschel mixer at a blade tip speed of 20 m/sec for 10 minutes to adhere the hydrophobic silica powder on the toner particles. The amount of the silica powder adhering with weak force was 0.32% based on the toner, and the sum of the amount of the silica powder adhering with weak force and that adhering with medium force was 0.83% based on the toner.

Each of the magnetic toners obtained in Examples 10 to 14 and Comparative Examples 3 to 4 was evaluated by a printing test on a printer "XP-15" modified model. The results obtained are shown in Table 2 below. Non-scatter of toner was evaluated by a sample chart.

TABLE 2

| | Initial Image Quality | | | | | Image Quality after Taking 50,000 Prints | | | | |
|---|---|---|---|---|---|---|---|---|---|---|
| Example No. | Image Density | Fog Resistance | Non-Scatter of Toner | Definition | Image Defect | Image Density | Fog Resistance | Non-Scatter of Toner | Definition | Image Defect |
| Example 10 | 1.50 | excellent | excellent | excellent | none | 1.46 | excellent | excellent | excellent | none |
| Example 11 | 1.48 | excellent | excellent | excellent | none | 1.45 | excellent | excellent | excellent | none |
| Example 12 | 1.44 | excellent | excellent | excellent | none | 1.43 | good | good | good | none |
| Example 13 | 1.50 | excellent | excellent | excellent | none | 1.44 | excellent | excellent | excellent | white spots |
| Example 14 | 1.49 | excellent | excellent | excellent | none | 1.44 | excellent | excellent | excellent | white spots |
| Compar. Example 3 | 1.48 | poor | good | good | none | 1.39 | poor | good | good | none |
| Compar. Example 4 | 1.29 | excellent | good | poor | none | 1.29 | excellent | good | poor | none |

As described and demonstrated above, the magnetic toner according to the present invention provides a toner image excellent in image density, definition, dot and fine line reproducibility, gradation, and NVO characteristics with a reduced consumption while minimizing the magnetic powder content. The magnetic toner exhibits satisfactory fixing properties in terms of fixing latitude, low fixing heat energy, and crease characteristics. The magnetic toner has a sufficiently broad anti-fog latitude. The magnetic toner exhibits excellent performance stability against environmental changes, especially in a low temperature and low humidity environment. The magnetic toner abrades a latent image carrier to a moderate degree so that image running, toner fusion and offset can be prevented.

While the invention has been described in detail and with reference to specific examples thereof, it will be apparent to one skilled in the art that various changes and modifications can be made therein without departing from the spirit and scope thereof.

What is claimed is:

1. A magnetic toner comprising a binder resin having dispersed therein a magnetic powder, wherein the magnetic toner has a volume average particle diameter ($D_{50}$) of from 4 to 9 μm, the magnetic powder has a number average particle diameter of from 0.15 to 0.25 μm, a BET specific surface area of from 6 to 8 $m^2/g$, and a residual magnetization of from 7 to 10 emu/g, the magnetic powder is present in an amount of from 30 to 70% based on the total weight of the magnetic toner, and the magnetic toner has adhered to the surface thereof silica powder having been rendered hydrophobic.

2. The magnetic toner as claimed in claim 1, wherein said magnetic toner has an absolute charge quantity of from 30 to 60 μC/g.

3. The magnetic toner as claimed in claim 1, wherein the amount of the silica powder adhering to the surface of the toner with weak force is not more than 0.35% by weight based on the toner, and the sum of the amount of the silica powder adhering to the surface of the toner with medium force and that of the silica powder adhering to the surface of the toner with weak force is not less than 0.25% by weight based on the toner.

4. The magnetic toner as claimed in claim 1, wherein said magnetic powder has a hexagonal shape.

5. The magnetic toner as claimed in claim 1, wherein said magnetic powder contains from 0.05 to 0.25% by weight of sulfur.

6. The magnetic toner as claimed in claim 1, wherein said silica powder having been rendered hydrophobic is silica powder having been rendered hydrophobic by treatment with silicone oil.

7. The magnetic toner as claimed in claim 1, wherein the magnetic powder has a number average particle diameter of from 0.18 to 0.23 μm.

8. The magnetic toner as claimed in claim 1, wherein the magnetic powder has a BET specific surface area of from 6.2 to 7.8 $m^2/g$.

9. The magnetic toner as claimed in claim 1, wherein the magnetic powder has a residual magnetism of from 7.5 to 9.4 emu/g.

10. The magnetic toner as claimed in claim 1, wherein the magnetic powder has a residual magnetism of from 7.7 to 9.2 emu/g.

11. The magnetic toner as claimed in claim 1, wherein the magnetic powder is present in an amount of from 30 to 60% by weight based on the weight of the magnetic toner.

12. The magnetic toner as claimed in claim 1, wherein the magnetic powder is present in an amount of from 35 to 45% by weight based on the weight of the magnetic toner.

13. The magnetic toner as claimed in claim 1, wherein said magnetic powder contains 0.1 to 0.25% by weight of sulfur.

14. The magnetic toner as claimed in claim 1, wherein said magnetic powder contains 0.12 to 0.23% by weight of sulfur.

15. The magnetic toner as claimed in claim 1, wherein the hydrophobic silica powder is present in an amount of from 0.5 to 5% by weight based on the toner.

16. The magnetic toner as claimed in claim 3, wherein the amount of the silica powder adhering to the surface of the toner with weak force is not more than 0.3% by weight based on the toner.

17. The magnetic toner as claimed in claim 3, wherein the amount of the silica powder adhering to the surface of the toner with weak force is not more than 0.25% by weight based on the toner.

18. The magnetic toner as claimed in claim 3, wherein the sum of the amount of the silica powder adhering to the surface of the toner with medium force and the silica powder adhering to the surface of the toner with weak force is not less than 0.25% by weight based on the weight of the toner.

19. The magnetic powder as claimed in claim 3, wherein the sum of the amount of silica powder adhering to the surface of the toner with medium force and the silica powder adhering to the surface of the toner with weak force is not less than 0.35% by weight based on the weight of the toner.

20. The magnetic toner as claimed in claim 3, wherein the sum of the amount of the silica powder adhering to the surface of the toner with medium force and the silica powder adhering to the surface of the toner with weak force is not greater than 0.6% by weight based on the weight of the toner.

* * * * *